US006739054B2

(12) United States Patent
Oswald

(10) Patent No.: US 6,739,054 B2
(45) Date of Patent: May 25, 2004

(54) RAZOR

(75) Inventor: Mathias Oswald, Werndorf (AT)

(73) Assignee: Payer Elektroprodukte Ges.m.b.H., St. Bartholoma (AT)

( * ) Notice: Subject to any disclaimer, the term of this patent is extended or adjusted under 35 U.S.C. 154(b) by 0 days.

(21) Appl. No.: 10/148,314

(22) PCT Filed: Dec. 1, 2000

(86) PCT No.: PCT/AT00/00323

§ 371 (c)(1),
(2), (4) Date: May 29, 2002

(87) PCT Pub. No.: WO01/39936

PCT Pub. Date: Jun. 7, 2001

(65) Prior Publication Data

US 2002/0178586 A1 Dec. 5, 2002

(30) Foreign Application Priority Data

Dec. 3, 1999 (AT) ..... 839/99

(51) Int. Cl.[7] ..... B26B 19/20
(52) U.S. Cl. ..... 30/34.1; 30/43.1; 30/43.9
(58) Field of Search ..... 30/34.1, 34.2, 30/43.1, 43.92, 34.05

(56) References Cited

U.S. PATENT DOCUMENTS 3,781,990 A * 1/1974 Loner ..... 30/34.1
4,803,780 A * 2/1989 Locke et al. ..... 30/34.1
4,866,843 A * 9/1989 Kumano ..... 30/34.1
5,507,095 A * 4/1996 Wetzel et al. ..... 30/34.1
5,964,034 A * 10/1999 Sueyoshi et al. ..... 30/34.2
6,226,869 B1 * 5/2001 Heintke et al. ..... 30/34.1

FOREIGN PATENT DOCUMENTS

DE 25 17 922 A1 11/1975 ..... B26B/19/10
DE 31 11 871 A * 1/1982
DE 41 17 990 A1 12/1992 ..... B26B/19/10
DE 198 22 094 A * 11/1999
WO 98 07550 A * 2/1998

* cited by examiner

*Primary Examiner*—Hwei-Siu Payer
(74) *Attorney, Agent, or Firm*—Chapman and Cutler LLP

(57) ABSTRACT

In an electric shaver including at least one electromotor arranged in a housing and a shaver head as well as an adjustably arranged long-hair cutting system or trimmer and an actuating switch (2), the actuating switch is mechanically coupled with the trimmer (5) for movement in the same direction and the trimmer (5) is displaceable from a first, resiliently mounted operating position into a second, further extended position. A part (11) of the trimmer (5) serving as a skin protecting member is entrained in the direction of displacement as far as to a stop (15) over a displacement path that is shorter than that of the trimmer (5).

25 Claims, 5 Drawing Sheets

RAZOR

BACKGROUND OF THE INVENTION

The invention relates to an electric shaver including at least one electromotor arranged in a housing and a shaver head as well as an adjustably arranged long-hair cutting system or trimmer and an actuating switch.

Electric shavers, usually, comprise a plurality of different cutting systems. Besides oscillating blade blocks which cooperate with shaving blades, various other cutting systems and, in particular, long-hair cutting systems are known. Trimmers or long-hair cutting systems are usually displaced by means of an actuating switch into a position in which they become active, long-hair cutters arranged to be foldable out of the plane of the housing and connected with the oscillation drive being known as well.

Such long-hair cutting systems in which the cutting tools cooperate with a comb comprise known configurations including displaceable skin protecting elements in order to reduce the risk of injury and the risk of damage to the blades. Such a long-hair cutting system is known from WO 98/07550, comprising a cutting edge formed by the cutting teeth of an upper cutter as well as a lower cutter, relative to which a skin protecting element is displaceable by the aid of a separate actuation member. By actuating this separate actuation member, the skin protecting element may, thus, be placed into a position in which the upper edge of the skin protecting element is adjacent to the cutting teeth, and into a position in which the cutting teeth lie bare, thus exerting a better long-hair cutting effect.

SUMMARY OF THE INVENTION

The invention aims to provide an electric shaver of the initially defined kind, which enables a plurality of operating positions to be assumed by means of a common actuating switch, and by which, in particular, both the function of a second shaver head and the function of a long-hair cutter can be realized by a single long-hair cutting system or trimmer without the latter requiring additional cutter heads. To solve this object the configuration according to the invention essentially consists in that the actuating switch is mechanically coupled with the trimmer for movement in the same direction and the trimmer is displaceable from a first, resiliently mounted operating position into a second, further extended position, and that a trimmer part serving as a skin protecting means is entrained in the direction of displacement as far as to a stop over a displacement path that is shorter than that of the trimmer. Due to the fact that the actuating switch is mechanically coupled with the trimmer for movement in the same direction, various operating states can be directly adjusted by the actuation of the operating or actuating switch, whereby the trimmer, in a first operating position of the trimmer, is resiliently mounted in the housing and can assume the function of a second shaving system. Due to the fact that the trimmer can be moved into a second, further extended position by means of the operating or actuating switch, it is feasible to place the trimmer into a position in which it can be employed as a long-hair cutting system, and due to the fact that a trimmer part serving as a skin protecting means is entrained in the direction of displacement as far as to a stop over a displacement path that is shorter than that of the trimmer during said movement into the second, further extended position, the cutting system of the trimmer is immediately released in a suitably manner so as to provide an effective long-hair cutting system.

In the first, resiliently mounted operating position, in which the trimmer virtually functions as an additional shaver head, the trimmer is preferably elastically deformable just as the shaver head, whereby the configuration advantageously is devised such that the trimmer is resiliently supported in a trimmer housing.

Advantageously, the configuration is devised such that the trimmer carries a T-shaped cutting tool whose T-beam plane extending normal to the direction of displacement, in the first operating position, is held resiliently in a position and substantially coincides with a tangential plane of the shaver head such that in this first, resiliently mounted operating position a substantially plane envelope is formed, which safeguards the contact of the two cutting systems with the skin without requiring a change in the usual handling of an electric shaver. The trimmer is resiliently mounted in its trimmer housing so as to ensure the simultaneous entering into effect of the two cutting systems upon manual pivoting of the shaver in different positions.

In the second operating position of the trimmer, in which the trimmer is to function as a long-hair cutting system, the trimmer is further extended such that in this position merely the trimmer is active, while the skin protecting means is, at the same time, held back in this position in order to appropriately release the cutting teeth and be able to safely seize long hairs. Advantageously, the configuration in this case is devised such that the T-beam plane extending normal to the direction of displacement in the second operating position of the trimmer is located higher than the tangential plane of the shaver head extending parallel to this plane. Since the operating or actuating switch is usually displaced from one position into the next position only over a short path due to the limited housing dimensions and in order to facilitate handling, and the release of the trimmer in the second operating position advantageously calls for a trimmer displacement path that is larger than the displacement path of the actuating switch, the configuration advantageously is devised such that the trimmer is connected with the actuating switch via a transmission gear designed, in particular, as an angle lever. In this manner, it is feasible to extend the trimmer over, for instance, more than 7 mm at a displacement path of the actuating or operating switch of, for instance, only 4 mm and to obtain the appropriate release of the cutting teeth by the simultaneous restriction of the path of the skin protecting means.

In the second operating position, in which the trimmer is to function as a long-hair cutting system, the resilience of the trimmer is no longer desired. Therefore, the configuration advantageously is devised such that the trimmer in its second operating position cooperates in a positive and force-transmitting or frictionally engaged manner with stops that block the resilient movement of the trimmer.

In order to ensure, during the retraction of the trimmer, the safe return of the displacement path caused by the actuation members cooperating with the actuating switch, the configuration advantageously is devised such that the trimmer housing, in its extended, second position, is pressed against springs having spring travels corresponding to the displacement path between said first and second positions. When pulling back the actuating switch, the trimmer housing, by the force of these springs, is thus returned into its original position, in which the resilient suspension and support of the trimmer within the trimmer housing is ensured again.

In order to limit the outward path of the skin protecting means in the first, resiliently mounted operating position of the trimmer, the configuration advantageously is devised such that the skin protecting means is overlapped by an externally arranged comb of the trimmer. The externally arranged comb overlapping the skin protecting means thus entrains the skin protecting means during the inward movement of the trimmer so as to cause the skin protecting means to reassume its external position relative to the trimmer, in which the risk of injury is reduced. In order to promote the movement of the skin protecting means relative to the trimmer into this starting position, the configuration advantageously is devised such that the part serving as a skin protecting means can be entrained into its external end position against the force of a spring supported on the trimmer. In a particularly simple manner, the trimmer, which is resiliently supported within a trimmer housing, is able to cooperate with the actuating switch via actuating members capable of being displaced in the direction of the force of these springs with the trimmer, such an effective direction of the actuating members at the same time ensuring that, in the outwardly displaced second, further extended position, the action of the springs is blocked and the trimmer is directly supported on the actuating members. In this manner it is safeguarded that no elastic resilience will occur any longer if the trimmer is used in the second, further extended position, thus favoring the use as a long-hair cutting system.

In a preferred manner, the trimmer part serving as a skin protecting means is designed as a comb, wherein a comb may also be arranged on the trimmer side facing the shaver head. The comb arranged on the trimmer side facing the shaver head may, however, be replaced with a hair-raising element comprised, for instance, of lamellae or soft plastic.

BRIEF DESCRIPTION OF THE DRAWINGS

In the following, the invention will be explained in more detail by way of an exemplary embodiment schematically illustrated in the drawing. Therein.

DETAILED DESCRIPTION OF THE INVENTION

Figure 1:
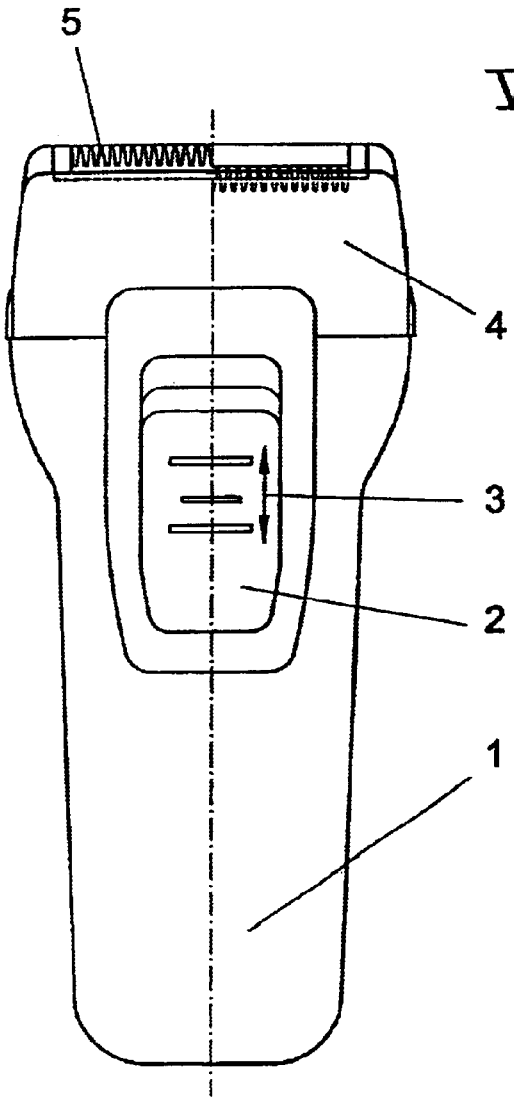
FIG. 1 is a front view of the electric shaver on the actuating switch in the switched-off position, the shaving systems keeping substantially the same position in the operating state.
Figure 2:
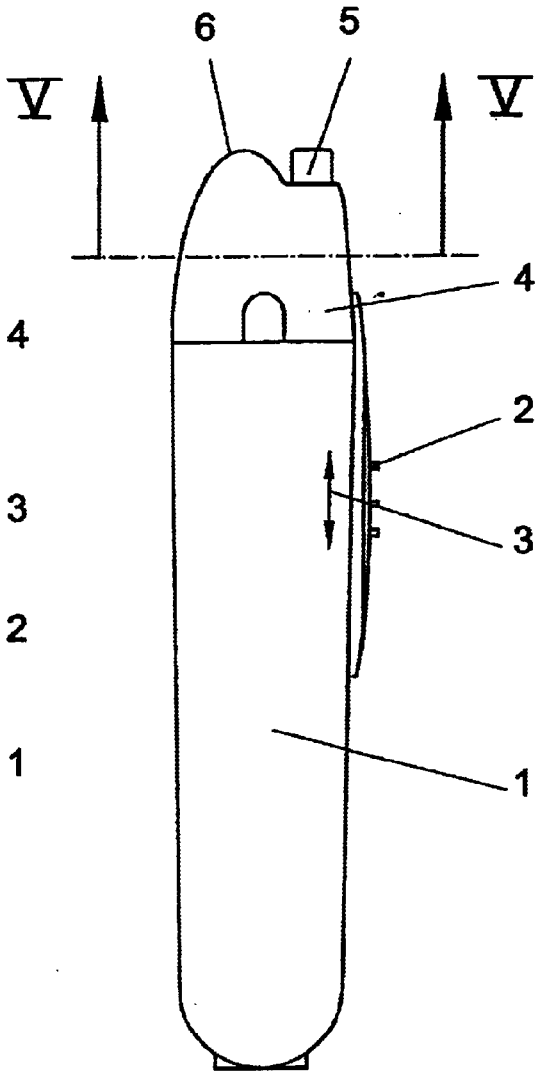
FIG. 2 is a side view on the representation according to FIG. 1.
Figure 3:
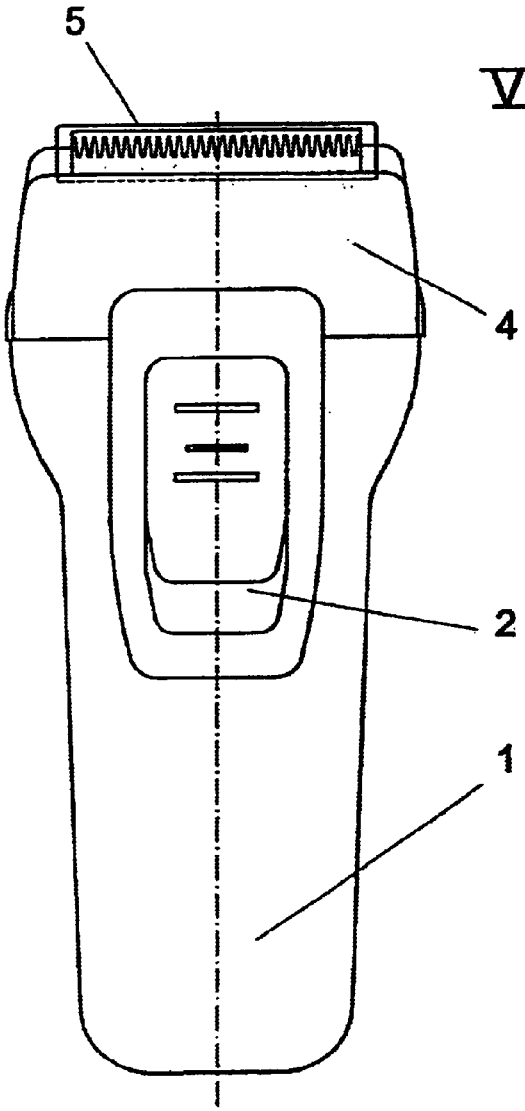
FIG. 3 is a front view analogous to FIG. 1 in a position of the actuating switch, in which the trimmer is extended.
Figure 4:
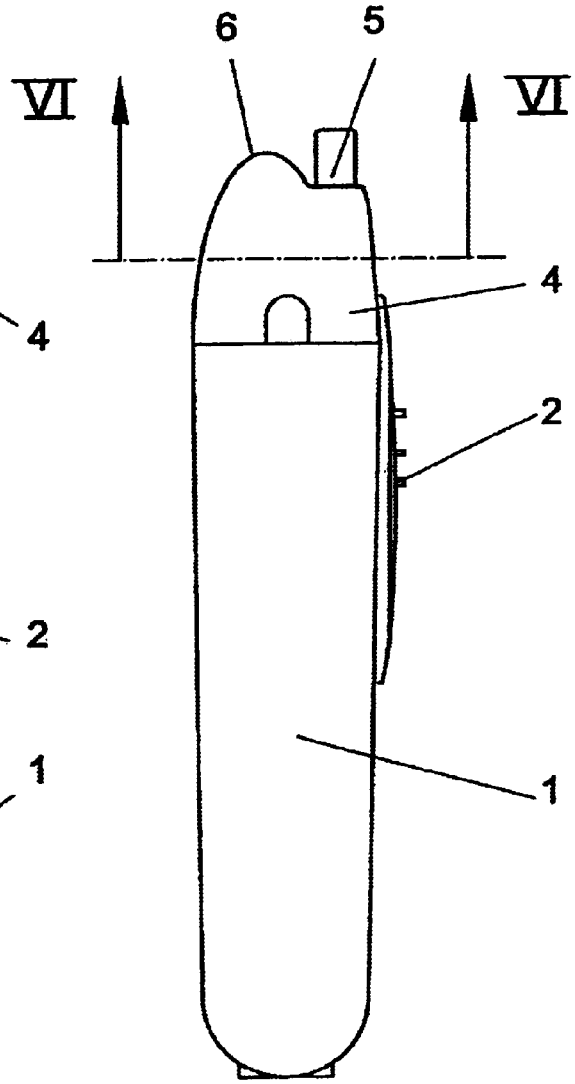
FIG. 4 is a side view on the representation according to FIG. 3.

FIG. 1 depicts an electric shaver 1 whose actuating switch is denoted by 2. The actuating switch can be moved upwards and downwards in the sense of double arrow 3, whereby, in addition to an off-position, a first operating position and a second position in which the trimmer is extended are assumed. The shaver head is denoted by 4, and 5 serves to indicate a trimmer which can be resiliently moved up and down between the positions illustrated in FIG. 1 as long as the actuating switch is in the off-position or in the first operating position. From the illustration according to FIG. 2, the outer contour 6 of the shaving blade of the shaving system is apparent beside the trimmer, which is schematically indicated by 5. In the illustration according to FIG. 3, the actuating switch 2 is displaced upwards in its second operating position, in which the trimmer 5 has reached its extended position as can be seen, in particular, from the side view according to FIG. 4.

Figure 5:
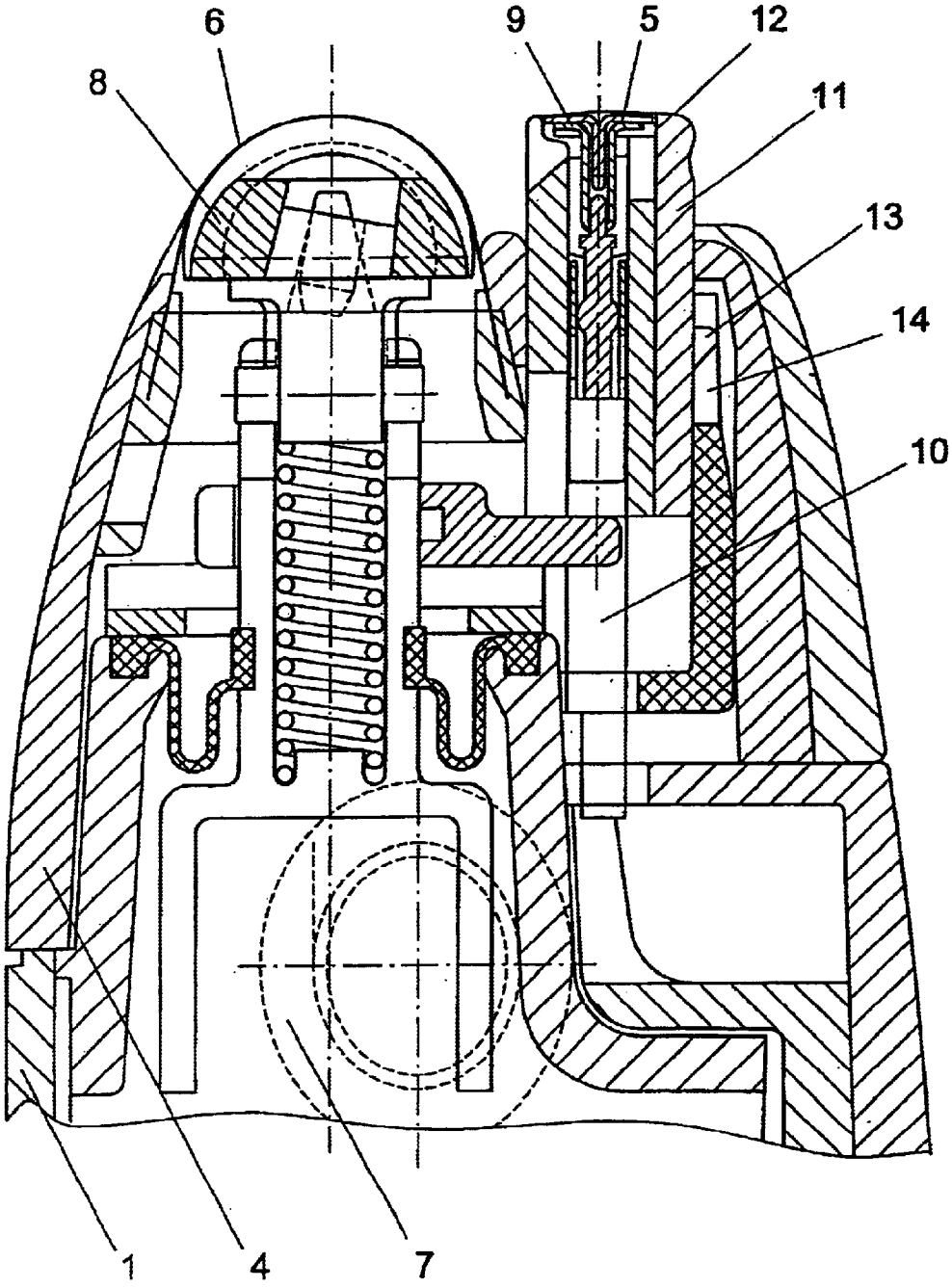
FIG. 5 is a section along line V/V of FIG. 2.
Figure 6:
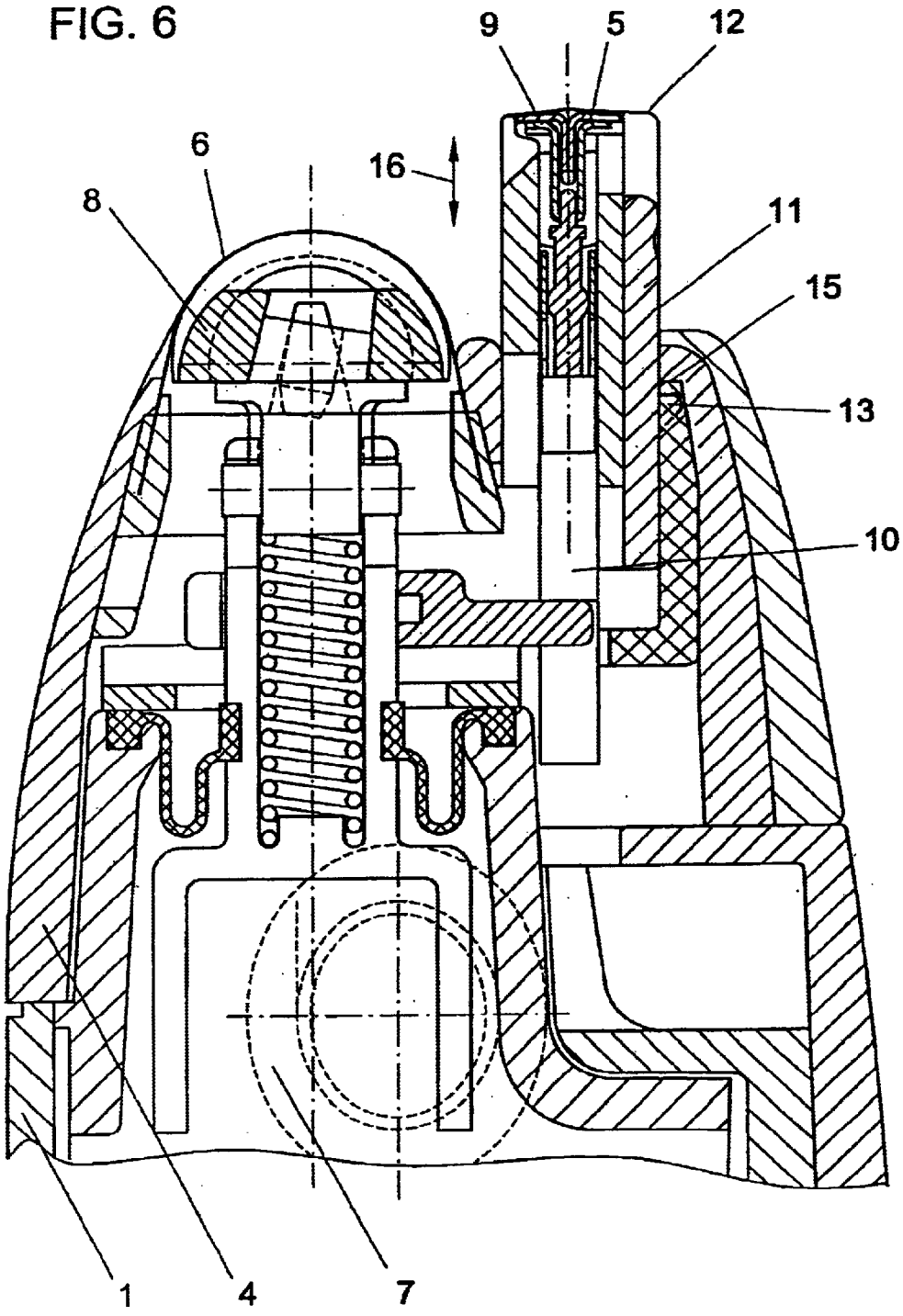
FIG. 6 is a section along line VI/VI of FIG. 4.
Figure 7:
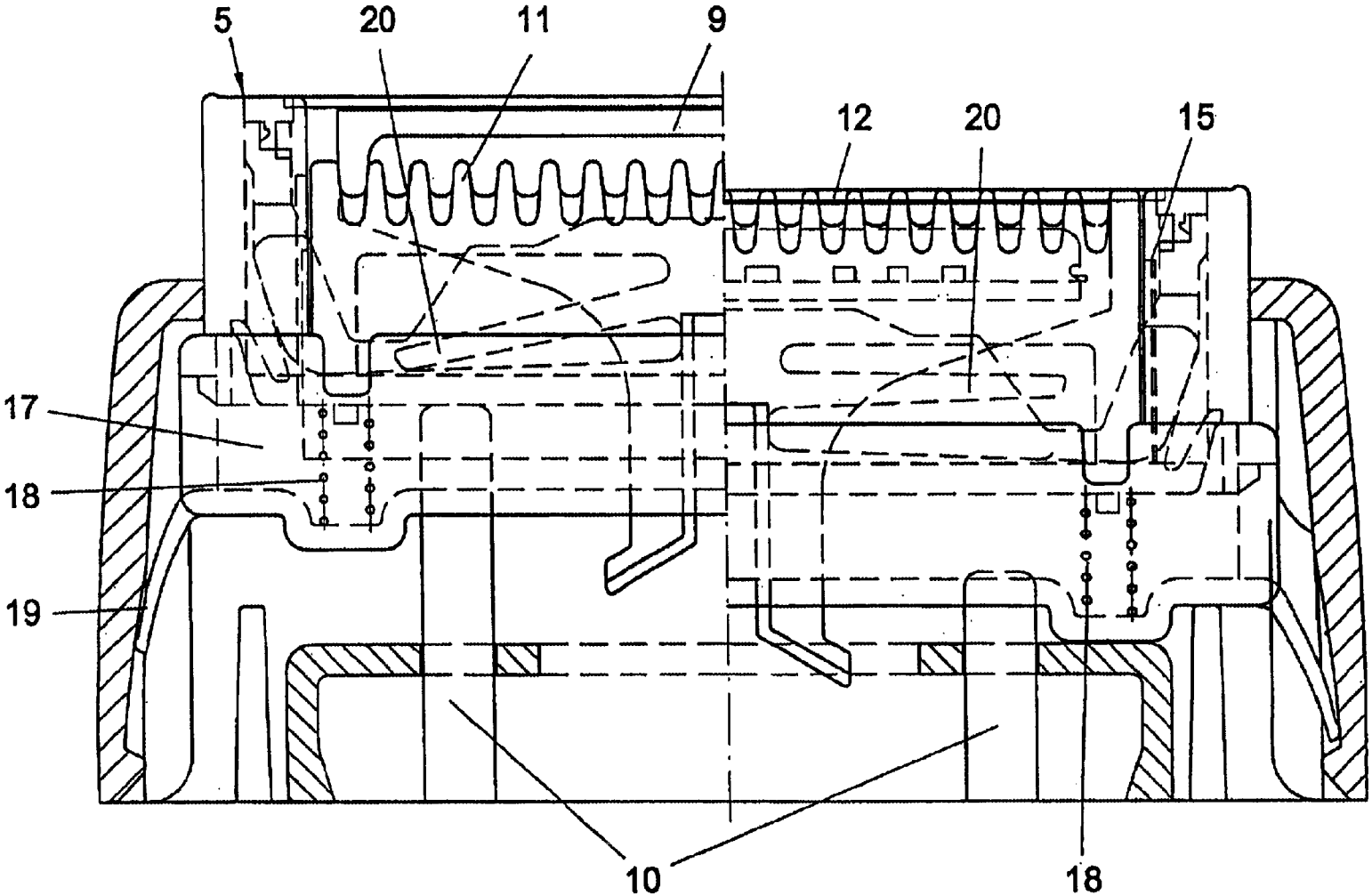
FIG. 7 is a section through a partial region of the head in the direction of the oscillating cutting movement of the cutter blades with the components being partially illustrated in section.

The courses of movement during the displacement of the actuating switch 2 are illustrated even more clearly in the enlarged sectional illustrations of FIGS. 5, 6 and 7. In the housing of the shaver 1, a drive motor is schematically indicated by 7, which sets into oscillating movement both a cutter blade block 8 cooperating with the shaving blade 6 and a cutting tool 9 provided in the interior of the trimmer 5. An actuating member 10 is connected with the actuating switch 2 via a suitable transmission. The trimmer 5 itself is resiliently supported in a trimmer housing and in that position is inwardly displaceable against the force of the spring.

From the illustration according to FIG. 5 a part 11 serving as a skin protecting means is apparent, which is displaced outwards relative to the trimmer 5 in the first operating position as depicted in FIG. 5, thus cooperating with the upper edge of the trimmer 5 or the external comb 12. The skin protecting means 11 carries a nose 13, which is in a free space 14 in the first operating position as well as in the off-position, thus enabling the trimmer 5 to freely move inwards under spring action together with the skin protecting means 11.

By actuating the operating switch 2, the actuating member 10 is then displaced into an upper position as shown in FIG. 6. During the outward movement of the trimmer 5 into the second operating position, the skin protecting means 11 is stopped with its nose 13 by an inwardly oriented projection 15 of the head 4 and held back by said projection, whereby the trimmer 5 can be displaced further outwards in the sense of double arrow 16 in accordance with its direction of movement. In the second position, which is illustrated in FIG. 6, the trimmer 5 is rigidly supported, and on account of the stops 13 and 15 the skin protecting means 11 is in a retracted position relative to the comb 12, in which the cutting teeth are released better.

In FIG. 7, the two operating positions of the trimmer are more clearly illustrated once again. The trimmer 5 is resiliently mounted in a trimmer housing 17 with the interposition of pressure springs 18 and, in the first operating position illustrated on the right-hand side, can, thus, be moved inwards while overcoming the force of these springs 18 so as to ensure the resilient abutment of the trimmer on the skin. The actuating members 10, which are fork-shaped, act directly on the trimmer in a manner that, after a predetermined stroke, said actuating members 10 come to abut against the trimmer and move the same outwards. By the actuating members 10 abutting against the trimmer 5, a spring deflection via the springs 18 is blocked and the trimmer can reach the outwardly displaced, second operating position illustrated on the left-hand side of FIG. 7. In this second operating position, into which also the housing 17 is entrained, springs 19 are biased, which, after the retraction of the actuating members 10, cause the housing 17 and hence the trimmer 5 to be retracted, whereby the respective spring travel stroke is released upon release of the respective travel stroke of the pressure springs 18 in the position illustrated on the right-hand side of FIG. 7.

During the outward displacement of the trimmer 5 a stop of the skin protecting means 11 cooperates with an elastically deformable arm 20, while said skin protecting means is, at the same time, held back by the stop 15 of the head, as is illustrated in FIG. 6. This resilient arm 20 is being relieved again as the housing 17 and the trimmer 5 are returned into the first operating position and will assume the position illustrated on the right-hand side of FIG. 7, in which the skin protecting means 11 is again automatically displaced into its outward position against the upper comb 12.

What is claimed is:

1. An electric shaver including at least one electromotor arranged in a housing, a shaver head, an adjustably arranged long-hair trimmer, and an actuating switch, wherein the actuating switch (2) is mechanically coupled with the trimmer (5) for movement in the same direction;

the trimmer (5) is displaceable from a first, resiliently mounted operating position into a second, further extended position;

the trimmer (5) is resiliently supported in a trimmer housing (17);

the trimmer (5) is connected with the actuating switch (2) via a transmission gear designed as an angle lever;

the trimmer (5) in its second extended position cooperates in a positive and frictionally engaged manner with stops that block the resilient movement of the trimmer (5);

the trimmer housing (17), in its extended, second position, is pressed against springs (18) having spring travel strokes corresponding to the displacement path between said first and second positions;

a means for skin protection (11) is arranged on the trimmer (5), said means for skin protection entrained in the direction of displacement of the trimmer (5) as far as to a stop (15), so that the displacement path of said means for skin protection is shorter than the displacement path of the trimmer (5);

the trimmer (5) carries a T-shaped cutting tool (9) whose T-beam plane extending normal to the direction of displacement in the first operating position is held resiliently in position, and substantially coincides with a tangential plane of the shaver head (6); and the T-beam plane extending normal to the direction of displacement in the second position of the trimmer (5) is located higher than the tangential plane of the shaver head (6) extending parallel to this plane;

the means for skin protection (11) is overlapped by an externally-arranged comb (12) on the trimmer (5);

the means for skin protection (11) can be entrained into its external end position against the force of a spring (20) supported on the trimmer (5);

the trimmer (5) cooperates with the actuating switch (2) via actuating members (10) capable of being displaced in the direction of the force of these springs (18) with the trimmer (5);

the means for skin protection (11) is designed as a comb; and wherein a hair-raising member is arranged on the side of the trimmer (5) facing the shaver head.

2. An electric shaver including at least one electromotor arranged in a housing, a shaver head, an adjustably arranged long-hair trimmer, and an actuating switch, wherein the actuating switch (2) is mechanically coupled with the trimmer (5) for movement in the same direction;

the trimmer (5) is displaceable from a first, resiliently mounted operating position into a second, further extended position;

a means for skin protection (11) is arranged on the trimmer (5), said means for skin protection entrained in the direction of displacement of the trimmer (5) as far as to a stop (15), so that the displacement path of said means for skin protection is shorter than the displacement path of the trimmer (5).

3. An electric shaver according to claim 2, wherein the trimmer (5) is resiliently supported in a trimmer housing (17).

4. An electric shaver according to claim 3, wherein the trimmer (5) carries a T-shaped cutting tool (9) whose T-beam plane extending normal to the direction of displacement in the first operating position is held resiliently in position, and substantially coincides with a tangential plane of the shaver head (6).

5. An electric shaver according to claim 4, wherein the T-beam plane extending normal to the direction of displacement in the second extending position of the trimmer (5) is located higher than the tangential plane of the shaver head (6) extending parallel to this plane.

6. An electric shaver according to claim 5, wherein the trimmer (5) is connected with the actuating switch (2) via a transmission gear designed as an angle lever.

7. An electric shaver according to claim 6, wherein the trimmer (5) in its second extended position cooperates in a positive and frictionally engaged manner with stops that block the resilient movement of the trimmer (5).

8. An electric shaver according to claim 7, wherein the trimmer housing (17), in its extended, second position, is pressed against springs (18) having spring travel strokes corresponding to the displacement path between said first and second positions.

9. An electric shaver according to claim 8, wherein the means for skin protection (11) is overlapped by an externally-arranged comb (12) on the trimmer (5).

10. An electric shaver according to claim 3, wherein the trimmer (5) is connected with the actuating switch (2) via a transmission gear designed as an angle lever.

11. An electric shaver according to claim 3, wherein the trimmer (5) in its second extended position cooperates in a positive and frictionally engaged manner with stops that block the resilient movement of the trimmer (5).

12. An electric shaver according to claim 3, wherein the trimmer housing (17), in its extended, second position, is pressed against springs (18) having spring travel strokes corresponding to the displacement path between said first and second positions.

13. An electric shaver according to claim 12, wherein the trimmer (5), which is resiliently supported within a trimmer housing (17), cooperates with the actuating switch (2) via actuating members (10) capable of being displaced in the direction of the force of these springs (18) with the trimmer (5).

14. An electric shaver according to claim 3, wherein the means for skin protection (11) is overlapped by an externally-arranged comb (12) on the trimmer (5).

15. An electric shaver according to claim 3, wherein the means for skin protection (11) can be entrained into its external end position against the force of a spring (20) supported on the trimmer (5).

16. An electric shaver according to claim 2, wherein the trimmer (5) carries a T-shaped cutting tool (9) whose T-beam plane extending normal to the direction of displacement in the first operating position is held resiliently in position, and substantially coincides with a tangential plane of the shaver head (6).

17. An electric shaver according to claim 16, wherein the T-beam plane extending normal to the direction of displacement in the second extended position of the trimmer (5) is located higher than the tangential plane of the shaver head (6) extending parallel to this plane.

18. An electric shaver according to claim 16, wherein a trimmer housing (17), in its extended, second position, is pressed against springs (18) having spring travel strokes corresponding to the displacement path between said first and second positions.

19. An electric shaver according to claim 18, wherein the trimmer (5), which is resiliently supported within a trimmer housing (17), cooperates with the actuating switch (2) via actuating members (10) capable of being displaced in the direction of the force of these springs (18) with the trimmer (5).

20. An electric shaver according to claim 2, wherein the trimmer (5) is connected with the actuating switch (2) via a transmission gear designed as an angle lever.

21. An electric shaver according to claim 2, where in the trimmer (5) in its second extended position cooperates in a positive and frictionally engaged manner with stops that block the resilient movement of the trimmer (5).

22. An electric shaver according to claim 2, wherein the means for skin protection (11) is overlapped by an externally-arranged comb (12) on the trimmer (5).

23. An electric shaver according to claim 2, wherein the means for skin protection (11) can be entrained into its external end position against the force of a spring (20) supported on the trimmer (5).

24. An electric shaver according to claim 2, wherein the means for skin protection (11) is designed as a comb.

25. An electric shaver according to claim 2, wherein a hair-raising member is arranged on the side of the trimmer (5) facing the shaver head.

* * * * *